US005473897A

United States Patent [19]

Elvekjaer

[11] Patent Number: 5,473,897

[45] Date of Patent: Dec. 12, 1995

[54] INTERNAL COMBUSTION ENGINE WITH EXHAUST-GAS TURBOCHARGING

[75] Inventor: Peter Elvekjaer, Baden, Switzerland

[73] Assignee: ABB Management AG, Baden, Switzerland

[21] Appl. No.: 395,832

[22] Filed: Feb. 28, 1995

[30] Foreign Application Priority Data

Mar. 18, 1994 [DE] Germany ..... 44 09 238.5

[51] Int. Cl.[6] ..... F02B 37/00

[52] U.S. Cl. ..... 60/612; 415/102

[58] Field of Search ..... 60/605.1, 612; 415/102

[56] References Cited

U.S. PATENT DOCUMENTS 4,464,902 8/1984 Mendle et al. ..... 60/612

FOREIGN PATENT DOCUMENTS 7004611 8/1972 Germany .

3108288A1 9/1982 Germany .

2-125924 5/1990 Japan ..... 60/612

*Primary Examiner*—Michael Koczo

*Attorney, Agent, or Firm*—Burns, Doane, Swecker & Mathis

[57] ABSTRACT

The object of the invention is to create an internal combustion engine, connected to two exhaust-gas turbochargers, with reduced flow losses and an improved efficiency which is particularly suitable for relatively high boosting. According to the invention this is achieved by virtue of the fact that in an apparatus in accordance with the preamble of claim 1, the two exhaust-gas turbochargers (1,1') are arranged offset sideways relative to one another. The diffuser outlets (5,5') of the radial turbines (2,2') are arranged point-symmetrically with respect to the center (8) of the central wall (6). The lateral spacing of the axes (9,9') of the radial turbines (2,2') from the wall (10,10') of the turbine outflow casing (3) on the outflow side (11,11') of the radial turbines (2,2') is designed so as to be greater than their lateral spacing from the other wall (12,12') in each case.

4 Claims, 2 Drawing Sheets

INTERNAL COMBUSTION ENGINE WITH EXHAUST-GAS TURBOCHARGING

BACKGROUND OF THE INVENTION

1. Field of the Invention

The invention relates to an internal combustion engine with exhaust-gas turbocharging which is connected to two exhaust-gas turbochargers.

2. Discussion of Background

German Utility Model 7,004,611 has disclosed an internal combustion engine on which two exhaust-gas turbochargers of identical construction are secured by means of support elements. They guide the exhaust gas flowing out in opposite directions into a simple turbine outflow casing arranged as a connecting element between them. However, this solution has the disadvantage that the exhaust gases are carried away relatively rapidly and hence without the possibility of recovering the energy of the exhaust gas.

DE-C2-31 08 288 has disclosed an internal combustion engine which likewise has two exhaust-gas turbochargers arranged opposite one another in the direction of flow and each having a radial compressor and a radial turbine, said internal combustion engine eliminating this disadvantage. For this purpose a number of components of a design favorable in terms of flow, which reduce the outflow velocity of the exhaust gases and thus ensure relatively high recovery of specific kinetic energy, are arranged in the common turbine outflow casing.

However, more recent exhaust-gas turbochargers operate with considerably higher boosting, smaller radial turbines producing exhaust-gas flows with a higher specific kinetic energy which is then converted into a higher static pressure. In radial turbines of this kind, the direction of rotation of the exhaust gases is opposite to the direction of rotation of the rotor of the turbine.

They produce a swirl in the exhaust gases resulting, for its part, in locally high flow velocities of the exhaust gases.

An apparatus in accordance with DE-C2-31 08 288, i.e. in particular the components designed in a manner favorable in terms of flow arranged in the turbine outflow casing, cannot be used for exhaust-gas turbochargers with considerably higher boosting without prejudicing the intended effect of, flow retardation with an increase in the static pressure. If this solution were used, the efficiency of the exhaust-gas turbocharger would thus in fact be reduced.

SUMMARY OF THE INVENTION

The invention seeks to avoid all these disadvantages. Accordingly, one object of the invention is to provide a novel internal combustion engine, connected to two exhaust-gas turbochargers, with reduced flow losses and an improved efficiency, which can be used, in particular, for relatively high boosting.

This is achieved, according to the invention, by the virtue of the fact that, in an apparatus in accordance with the preamble of claim 1, the two exhaust-gas turbochargers are arranged offset sideways relative to one another. The lateral spacing of the axes of the exhaust-gas turbochargers, i.e. the spacing of an imaginary extension of the axes, from the wall of the turbine outflow casing is designed so as to be greater on the outflow side of the radial turbines than the lateral spacing from the respectively opposite wall. The diffuser outlets of the radial turbines are arranged point-symmetrically with respect to the center of the central wall.

Adequate space is thereby provided on the outflow side of the exhaust gas between the respective outlet of the radial turbine and the wall of the turbine outflow casing, allowing the exhaust gas, which flows predominantly along this region, can be carried away via the flue without being accelerated again. A significant advantage of the invention thus consists in the flow retardation of the exhaust gases, i.e. in the avoidance of flow losses and this irrespective of the boost capacity of the exhaust-gas turbochargers. This ensures an increase in the static pressure and hence in the efficiency of the turbochargers and the internal combustion engine.

In another embodiment of the invention, the turbine outflow casing comprises two casing parts which are designed so as to be laterally reversed with respect to one another, are connected to one another at the central wall and are shaped in accordance with the flow path of the two exhaust-gas flows. A particularly favorable outflow behavior of the exhaust gases is thereby advantageously achieved.

In a further embodiment of the invention, the flue is of at least approximately elliptical design. Its major axis is oriented towards the respective outflow sides of the radial turbines. Direct transfer of the exhaust gases to the flue and hence likewise a particularly favorable outflow behavior is in this way made possible.

In all embodiments of the invention, a funnel-shaped hub body, the base of which adjoins the central wall, is in each case arranged in the turbine outflow casing on an extension of the axes of the exhaust-gas turbochargers. This makes it possible to achieve an improvement in the outflow behavior of the exhaust gases even as they enter the turbine outflow casing.

BRIEF DESCRIPTION OF THE DRAWINGS

A more complete appreciation of the invention and many of the intended advantages thereof will be readily obtained as the same becomes better understood by reference to the following detailed description when considered in connection with the accompanying drawings, wherein.

DESCRIPTION OF THE PREFERRED EMBODIMENTS

Figure 1:
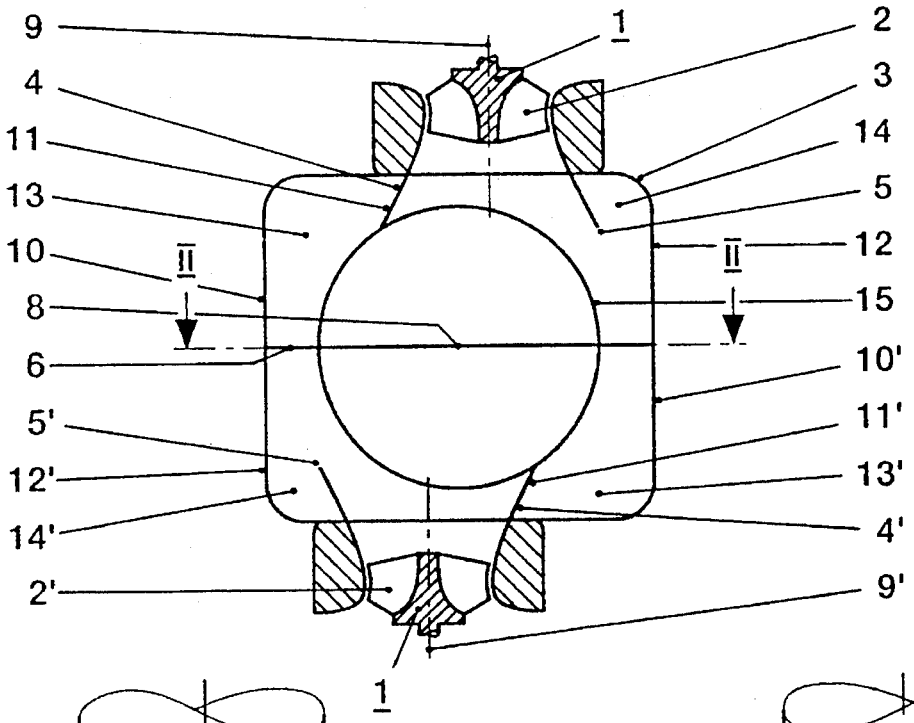
FIG. 1 shows a plan view of the turbine outflow casing.

Referring now to the drawings, wherein like reference numerals designate identical or corresponding parts throughout the several views, only those elements which are essential to an understanding of the invention are shown, parts of the system which are not shown being, for example, the internal combustion engine and the radial compressor of the exhaust-gas turbocharger, and the direction of flow of the working medium is indicated by arrows, an internal combustion engine is connected, for forced induction, to two exhaust-gas turbochargers 1,1', the radial turbines 2,2' of which open into a common turbine outflow casing 3. The radial turbines 2,2' each have an exhaust-gas diffuser 4,4', the diffuser outlet 5,5' of which projects into the turbine outflow casing 3. A central wall 6 separates the two exhaust-gas flows 7,7' from one another. The exhaust-gas turbochargers 1,1' are arranged in a common horizontal plane in a manner offset sideways relative to one another, and the diffuser outlets 5,5' are arranged symmetrically to the center 8 of the central wall 6.

The lateral spacing of the axes 9,9' of the exhaust-gas turbochargers 1,1' or radial turbines 2,2' from the wall 10,10' of the turbine outflow casing 3 is designed so as to be greater on the outflow side 11,11' of the radial turbines 2,2' than their lateral spacing from the respectively opposite wall 12,12'. This gives rise on the outflow side 11,11' to a free space 13,13' between the diffuser outlets 5,5' and the wall 10,10', this free space being designed to be considerably larger than the interspace 14,14' from the respectively opposite wall 12,12'. Arranged on the turbine outflow casing 3 is a central flue 15 (FIG. 1).

Figure 2:
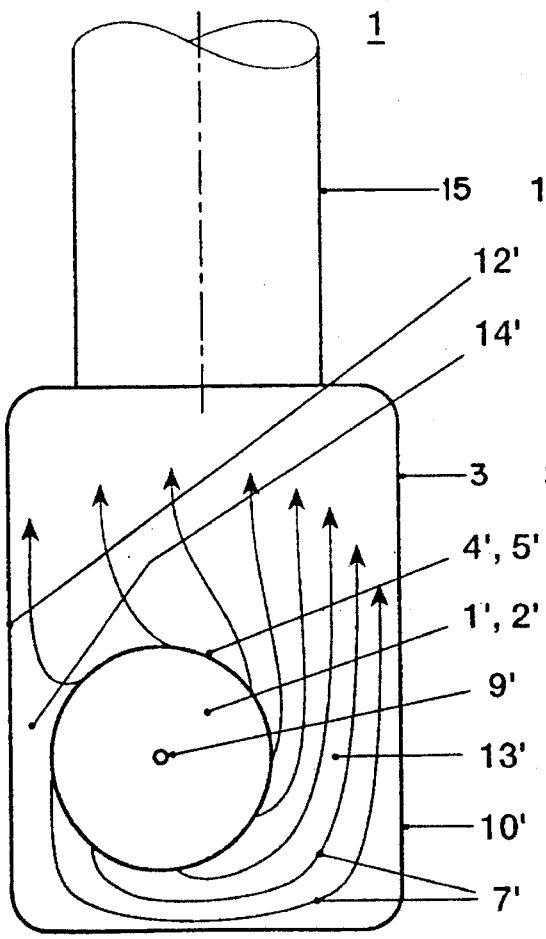
FIG. 2 shows a cross section through the turbine outflow casing along the line II—II in FIG. 1, viewed from behind.
Figure 3:
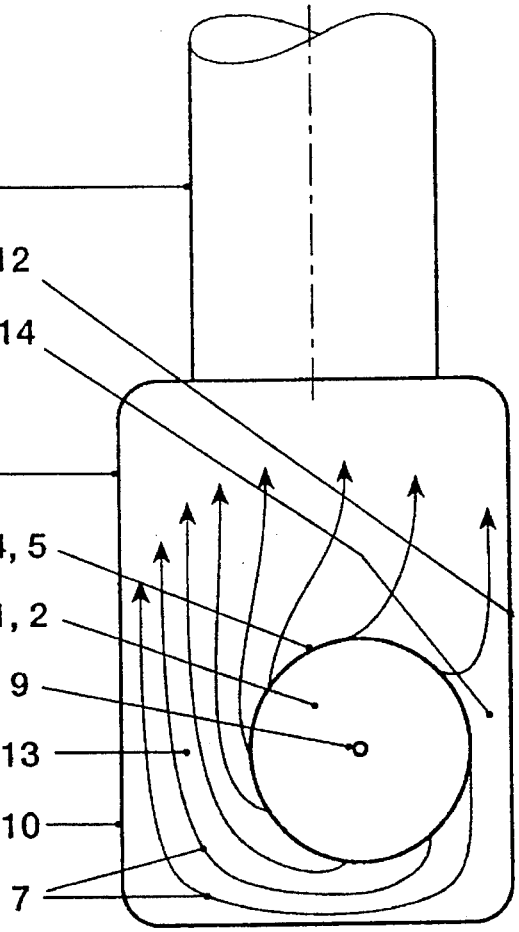
FIG. 3 shows a representation similar to that in FIG. 2 but viewed from the front.

Both exhaust-gas flows 7,7' coming from the radial turbines 2,2' are guided into the turbine outflow casing 3 by the diffuser outlets 5,5'. In the casing they pass, in each case on the outflow side 11,11', through the free space 13,13' enlarged in accordance with the invention into the flue 15 (FIG. 2, FIG. 3).

Figure 4:
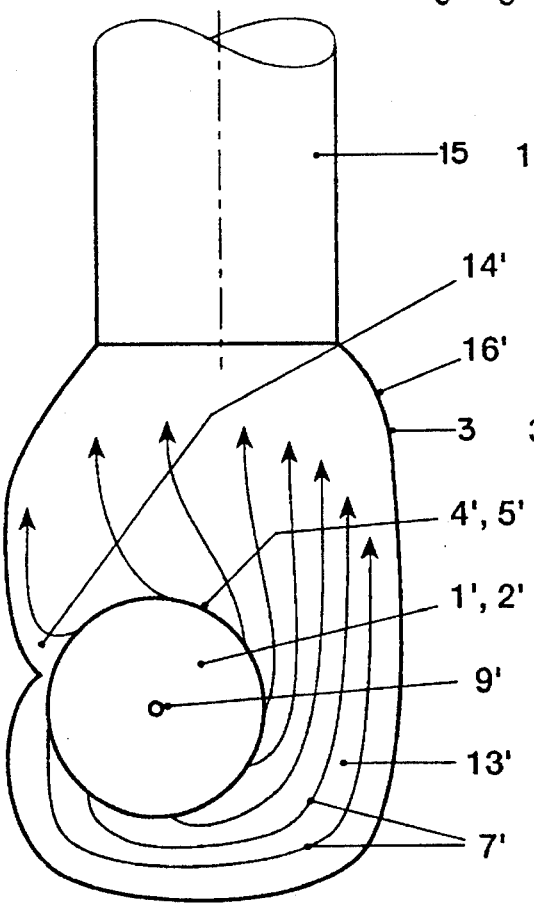
FIG. 4 shows a representation similar to that in FIG. 2 but in a different embodiment.
Figure 5:
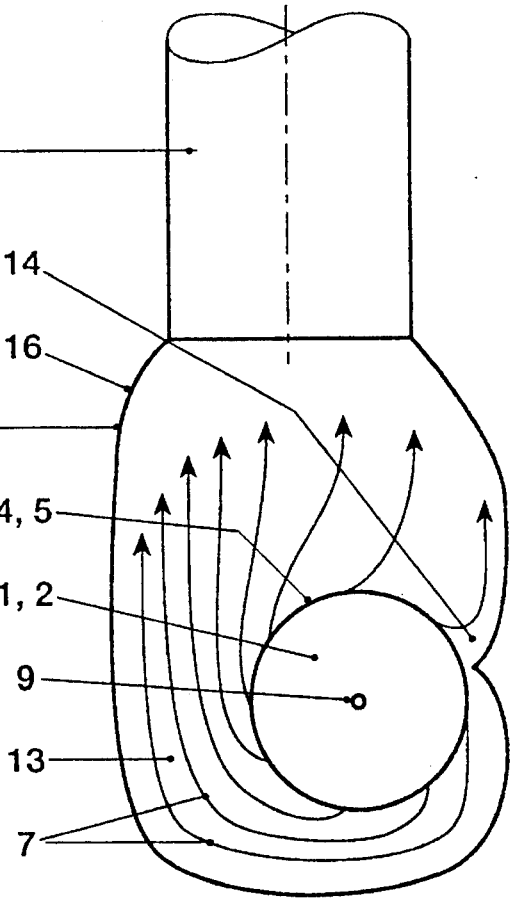
FIG. 5 shows a representation similar to that in FIG. 4 but viewed from the front.

In another exemplary embodiment, the turbine outflow casing 3 comprises two casing parts 16,16' which are designed so as to be laterally reversed with respect to one another, are connected to one another at the central wall 6 and are shaped in accordance with the flow path of the two exhaust-gas flows 7,7' (FIG. 4, FIG. 5). These casing parts guide the exhaust-gas flows 9,9' into the flue 15 in a manner favorable in terms of flow.

Figure 6:
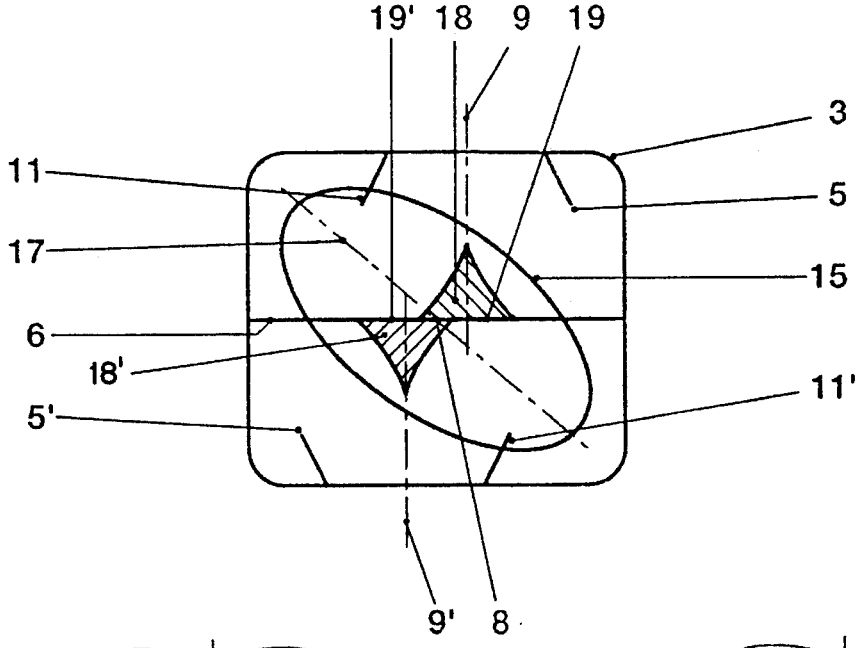
FIG. 6 shows a representation corresponding to that in FIG. 1 but in a different embodiment.

According to another exemplary embodiment, the flue 15 is of elliptical design. Its major axis 17 is oriented towards the respective outflow sides 11,11' of the radial turbines 2,2' (FIG. 6). Transfer of the exhaust-gas flows 7,7' from the turbine outflow casing 3 to the flue 15 in a manner favorable in terms of flow is thereby achieved.

In a further exemplary embodiment, funnel-shaped hub bodies 18,18', the bases 19,19' of which adjoin the central wall 5, are each arranged on an extension of the axes 9,9' of the exhaust turbochargers 1,1' (FIG. 6). The hub bodies 18,18' allow the exhaust-gas flows 7,7' to enter the turbine outflow casing 3 in a manner favorable in terms of flow.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. An internal combustion engine with exhaust-gas turbocharging, in which a) two exhaust-gas turbochargers of identical construction, each having a radial compressor and a radial turbine and being arranged in a common horizontal plane and opposite one another in the direction of flow, have a common turbine outflow casing into which the outflowing exhaust gas from the radial turbines is introduced, b) the two radial turbines each have an exhaust diffuser, the diffuser outlet of which projects into the turbine outflow casing and c) a central wall which separates the two exhaust-gas flows from one another before they are carried away via a flue arranged centrally on the turbine outflow casing, wherein d) the two exhaust-gas turbochargers are arranged offset sideways relative to one another, e) the lateral spacing of the axes of the exhaust-gas turbochargers from the wall of the turbine outflow casing on the outflow side of the radial turbines is designed so as to be greater than their lateral spacing from the respectively opposite wall and f) the diffuser outlets of the radial turbines are arranged point-symmetrically with respect to the center of the central wall.

2. The internal combustion engine as claimed in claim 1 wherein the turbine outflow casing comprises two casing parts which are designed so as to be laterally reversed with respect to one another, are connected to one another at the central wall and are shaped in accordance with the flow path of the two exhaust-gas flows.

3. The internal combustion engine as claimed in claim 1 wherein the flue is of at least approximately elliptical design and its major axis is oriented towards the respective outflow sides of the radial turbines.

4. The internal combustion engine as claimed in claim 1 wherein a funnel-shaped hub body, the base of which adjoins the central wall, is in each case arranged in the turbine outflow casing on an extension of the axes of the exhaust-gas turbochargers.

* * * * *